US007111435B2

(12) United States Patent
Flores

(10) Patent No.: US 7,111,435 B2
(45) Date of Patent: Sep. 26, 2006

(54) TILE APPLICATION GUIDES AND SYSTEM

(76) Inventor: Leo Flores, P.O. Box 467, Bonsall, CA (US) 92003

( * ) Notice: Subject to any disclaimer, the term of this patent is extended or adjusted under 35 U.S.C. 154(b) by 348 days.

(21) Appl. No.: 10/279,387

(22) Filed: Oct. 23, 2002

(65) Prior Publication Data

US 2004/0079045 A1 Apr. 29, 2004

(51) Int. Cl.
*E04F 13/08* (2006.01)
*E04G 21/18* (2006.01)

(52) U.S. Cl. ..... 52/387; 52/287.1; 52/391; 52/747.11; 52/127.3; 33/526

(58) Field of Classification Search ..... 52/307–308, 52/273, 127.3, 261, 264, 287.1, 384–387, 52/716.1, 716.3, 716.4, 717.01, 747.11, 749.11, 52/127.6, 391, 461; 33/526–527, 562, 587, 33/44, 567, 404
See application file for complete search history.

(56) References Cited

U.S. PATENT DOCUMENTS

| | | | | |
|---|---|---|---|---|
| 1,247,154 A | | 11/1917 | Robertson | |
| 1,489,572 A | | 4/1924 | Bennewitz | |
| 2,038,439 A | * | 4/1936 | Moss | 52/272 |
| 2,143,033 A | * | 1/1939 | Sakier | 52/35 |
| 2,570,430 A | | 10/1951 | Cramer | 33/194 |
| 2,827,558 A | | 3/1958 | Lents | 240/6.44 |
| 3,213,545 A | | 10/1965 | Wright | 33/207 |
| 3,611,664 A | * | 10/1971 | Barbera | 52/481.1 |
| 3,744,141 A | | 7/1973 | Strickland | 33/180 |
| 4,135,338 A | | 1/1979 | Malavasi | 52/387 |
| 4,516,373 A | | 5/1985 | Osawa | 52/387 |
| 4,660,292 A | | 4/1987 | Richardson | 33/451 |
| 4,712,309 A | | 12/1987 | Kingston et al. | 33/527 |
| 4,953,341 A | | 9/1990 | Joos | 52/747 |
| 5,073,430 A | | 12/1991 | Aidan | 428/43 |
| 5,259,161 A | | 11/1993 | Carter | 52/307 |
| 5,363,560 A | | 11/1994 | Makow | 33/527 |
| 5,377,447 A | * | 1/1995 | Fritch | 47/33 |
| 5,417,020 A | | 5/1995 | Dobija | 52/235 |
| 5,709,058 A | * | 1/1998 | Shaw | 52/404.1 |

(Continued)

FOREIGN PATENT DOCUMENTS

EP 0175014 A1 3/1986

(Continued)

OTHER PUBLICATIONS

Stanley company advertisement for "The Lighted/Magnetic Torpedo Level", copyright 2002.

*Primary Examiner*—Winnie Yip
(74) *Attorney, Agent, or Firm*—Frank G. Morkunas

(57) ABSTRACT

A tile application system having a trim guide and a field guide. The trim guide has a first, second, and third side, a a registration channel adjacent to the first side and perpendicular to the second side, a terminal end on the first side having a distance V from the second side. The field guide has a base, a first and second wall extending from the base, and a registration channel between each wall. Each wall has a length V from the base and a thickness X. The registration channels of each guide has a width Y. A leveler with a ledge of a thickness Y is insertable into any registration channel for aligning the guides vertically or horizontally or both. A support for the leveler has a channel and an extending ledge each with a width Y to accept the leveler and to insert into any registration channel.

36 Claims, 5 Drawing Sheets

U.S. PATENT DOCUMENTS

| | | | | | |
|---|---|---|---|---|---|
| 5,768,793 | A | | 6/1998 | Fields | 33/526 |
| 5,921,044 | A | * | 7/1999 | Holztrager | 52/483.1 |
| 5,950,370 | A | * | 9/1999 | Peck | 52/35 |
| 5,992,114 | A | * | 11/1999 | Zelinsky et al. | 52/426 |
| D427,325 | S | | 6/2000 | Ginzel | D25/119 |
| 2002/0157325 | A1 | * | 10/2002 | Domanico | 52/35 |

FOREIGN PATENT DOCUMENTS

| | | | |
|---|---|---|---|
| JP | 7-229268 | * | 8/1995 |
| WO | WO-95/18355 | | 7/1995 |

* cited by examiner

TILE APPLICATION GUIDES AND SYSTEM

CROSS REFERENCES TO RELATED APPLICATIONS

NONE.

STATEMENT REGARDING FEDERALLY-SPONSORED RESEARCH OR DEVELOPMENT

NONE.

BACKGROUND OF THE INVENTION

This present invention relates to an improvement in applying tiles of all types to vertical and horizontal surfaces, for establishing a true vertical surface on two dimensions and for establishing a true horizontal surface prior to applying a cement or mortar base thereon, and for registering tiles to a true vertical and horizontal upon final application.

Before tiles, particularly ceramic tiles, are applied to a surface, the artisan should, and generally does, try to create a flat and true horizontal cement or mortar base upon which the tiles shall be applied to that horizontal surface and should try to create a flat and true vertical cement or mortar base [this is referred to as 'mortar float' or 'cement float'] upon which tiles shall be applied to that vertical surface and thereafter to ensure that the tiles applied to the vertical surface are also applied horizontally and vertically perfect such that the final finished appearance reflects true horizontals and true verticals. In most applications, a mortar float of about one-half inch is established. A depth of more or less than one-half inch, however, may also be established as desired. The main reason for this mortar float is that not all walls, floors, and ceilings are perfectly flat, perfectly horizontal, or vertical throughout the entire surface, nor, where they adjoin, are they at perfect angles [typically at corners where a 90° angle is required or sought].

Generally a guide, such as a slat, or similar device, is employed for this purpose. In many instances, even with slats, many artisans craft novel approaches at shimming single-to-multiple slats or other objects in attempts to obtain better vertical and horizontal foundations for the cement or mortar base and follow-on tile application. There is no one guide system for creating such foundations or for providing a uniform guide system for applying field tile [i.e., tile which covers the surface area being tiled] and trim tile [i.e., tile which forms the perimeter edges of the field tile—typically the trim tile is a rounded tile referred to as a quarter round].

Two new innovative screeds to assist in such alignments are found in my patents, U.S. Pat. No. 6,393,788 issued on May 28, 2002, and U.S. Pat. No. 6,397,542 issued on Jun. 4, 2002. The screeds addressed in those patents solved many of the problems associated with preparing and creating accurately aligned mortar bases and tile alignment such as in kitchen and vanity counter tops where additional tiles are to be placed vertically from the horizontal top. No single patent has addressed the bigger-picture associated with vertical tile application and corner tile application, both from a continuous horizontal plane application into the vertical plane from a corner, nor addressed overall system application, nor addressed the need for illumination in new constructions where electricity and lighting are scarce to non-existent. The present invention has corrected these deficiencies.

Accordingly, several objects and advantages of my invention are to:

(a) provide a standardize system for tile application;

(b) create a simplified method of establishing a true horizontal plane upon which a mortar substrate may be applied prior to final tile application;

(c) create a simplified method of establishing a true two-dimensional vertical plane upon which a mortar substrate may be applied prior to final tile application; and (d) provide a registration system for tile application;

(e) establish a leveling device for use with a standardized tile application system which can function in construction sites having limited access to, or no, electricity.

The foregoing has outlined some of the more pertinent objects of the present invention. These objects should be construed to be merely illustrative of some of the more prominent features and applications of the intended invention. Many other beneficial results can be attained by applying the disclosed invention in a different manner or by modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

BRIEF SUMMARY OF THE INVENTION

The above-noted problems, among others, are overcome by the present invention. Briefly stated, the present invention contemplates a tile-application system and components for establishing a perimeter for a substrate to be filled, horizontally and vertically adjusted, aligned, and leveled with a mortar float, followed by registration and final application of tiles on the mortar float horizontally and vertically [or diagonally]. The guides associated with the tile-application system include a trim-perimeter guide having two sides approximately perpendicular to one another with a third side connected to the two sides and a registration in between. The trim-perimeter guide generally outlines the surfaces to be tiled. One or more field guides and vertically insertable within the perimeter so formed. The field guides have a base, two perpendicularly disposed wall extending from the base, with a registration channel defined between the two walls. The distance from the base to the ends of the walls is equal to the depth desired of the mortar float [represented herein as "V"]. The thickness of the walls is represented herein as "X". The width of the channels of the trim-perimeter guide and the field guide are approximately the same and represented herein as "Y".

The field guide has a rail member on the outside of either wall which accepts a shim device to be used to adjust the field guide vertically from front to back. A corner guide comprised of three sections has two upstanding walls extending from a first section base with a registration channel in between the two walls. A second section is adjacent to the first section. The base of the second section is planar with the base of the first section. The second section has a registration channel adjacent to one wall of the first section and above the base of the second section. A third section is adjacent to the second section. The base of the third section is approximately perpendicular to the base of the first section and adjoins the base of the first section defining a corner seat. The corner seat is fitted onto outside corners to be filled with mortar and tile after proper alignments. The distance from the base to the ends of the walls of the corner guide is approximately equal to "V". The width of the registration channels of the corner guide is approximately equal to "Y".

A tile application guide has an upper side and an approximately perpendicularly disposed lower side adjacent to the upper side. A crosspiece runs the length of the lower side. The crosspiece has a width approximately equal to "Y" and is adapted to align tiles vertically, horizontally, or vertically as necessary or desired.

A level apparatus has cylinder with a long side and a short side, an outward extending base, extending outward on one or more sides, a slot transverses the base and has a width of approximately equal to the thickness of a rail of an external screed. At least one leveling tube is inside the cylinder. The base has a thickness approximately equal to or greater than Y. A leveling support is adapted to receive the leveling device by any outward extending side of the level device. The leveling support has a first support side and a second support side, with the first support side having a ledge extending therefrom wherein the ledge has a width approximately equal to Y and the second support side has a channel perpendicular to the ledge wherein the channel has a width also approximately equal to Y.

The foregoing has outlined the more pertinent and important features of the present invention in order that the detailed description of the invention that follows may be better understood so the present contributions to the art may be more fully appreciated. Additional features of the present invention will be described hereinafter which form the subject of the claims. It should be appreciated by those skilled in the art that the conception and the disclosed specific embodiment may be readily utilized as a basis for modifying or designing other structures and methods for carrying out the same purposes of the present invention. It also should be realized by those skilled in the art that such equivalent constructions and methods do not depart from the spirit and scope of the inventions as set forth in the appended claims.

BRIEF DESCRIPTION OF THE DRAWINGS

For a fuller understanding of the nature and objects of the invention, reference should be had to the following detailed description taken in conjunction with the accompanying drawings in which.

DETAILED DESCRIPTION OF THE -INVENTION

Figure 14:
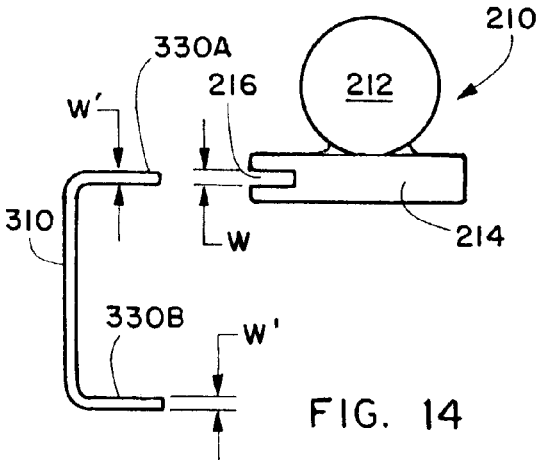
FIG. 14 is an end view of the leveling component used in conjunction with a screed having one or more extending rails.
Figure 10:
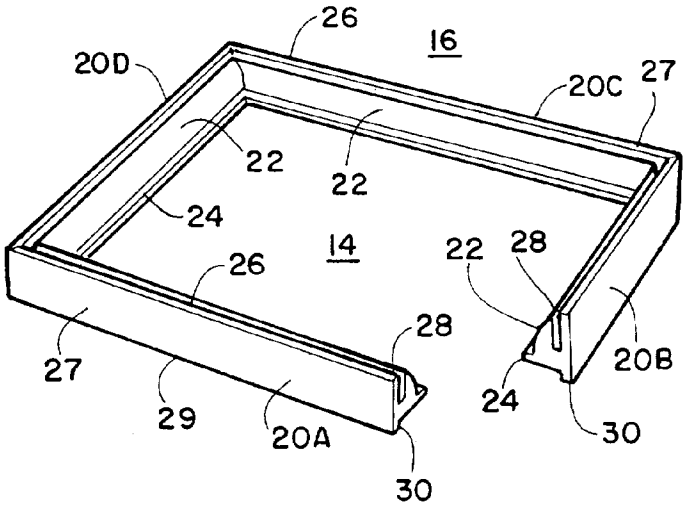
FIG. 10 is a detailed perspective view of a cut-out guide application.
Figure 9:
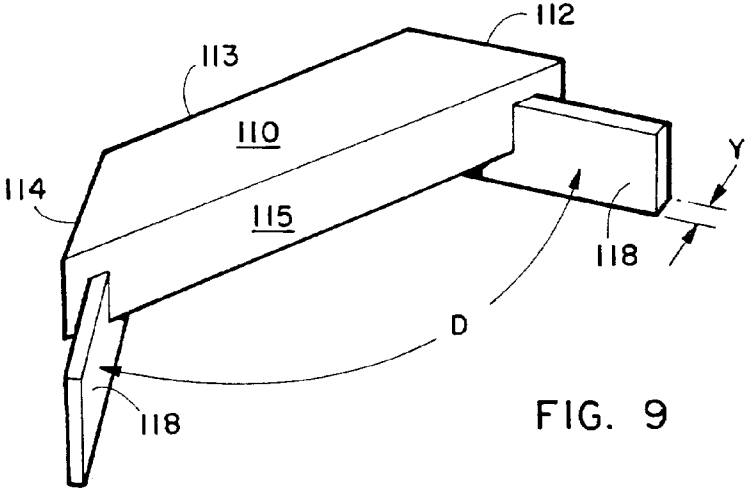
FIG. 9 is a perspective view of an angle registration device.
Figure 12:
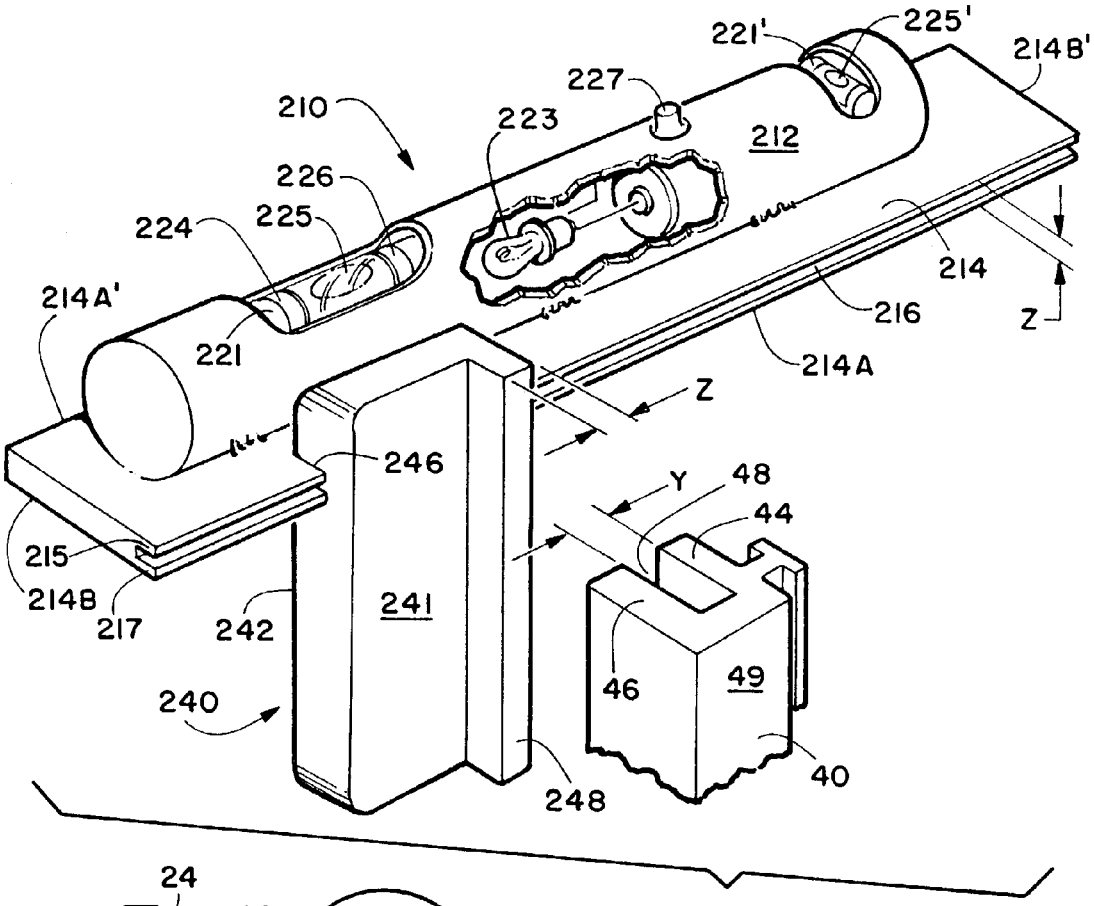
FIG. 12 is a detailed perspective view of the leveling component and support component of the guide application system.
Figure 13:
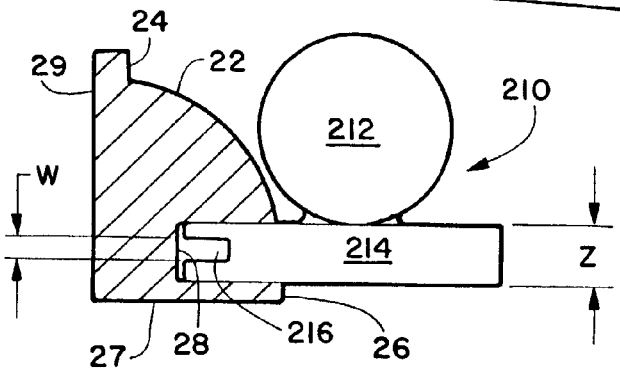
FIG. 13 is a cross-section end view of the leveling component used in conjunction with a trim guide.

FIGS. 1–3 and 16 generally illustrate what is referred to as the basic guide components of the system; FIGS. 4–6 illustrate what is referred to as the basic adjustment, alignment, or registration components for horizontal and vertical surfaces over a horizontal and vertical substrate, respectively [i.e., counter top or wall, respectively] and for the horizontal, vertical, and diagonal, or other geometric aspects desired for tile registration and application; FIGS. 9–10 illustrate what is referred to as the well or sink components of the system which are used as a guide for a horizontal cut-out surface where the cut-out is filled, for example, with a sink; and FIGS. 12–14 illustrate what is referred to as the vertical and horizontal leveling and illumination components of the system.

Figure 1:
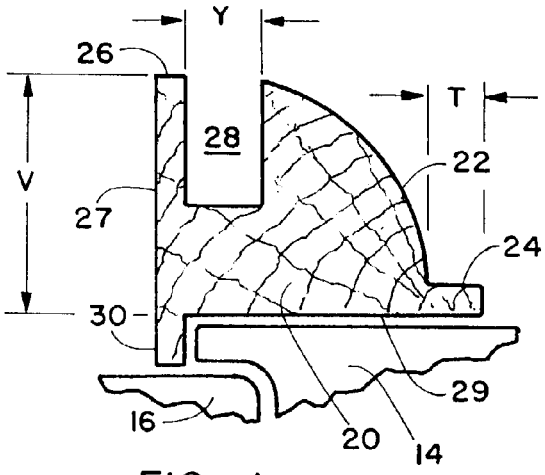
FIG. 1 is cross-section end view of a trim guide.
Figure 2:
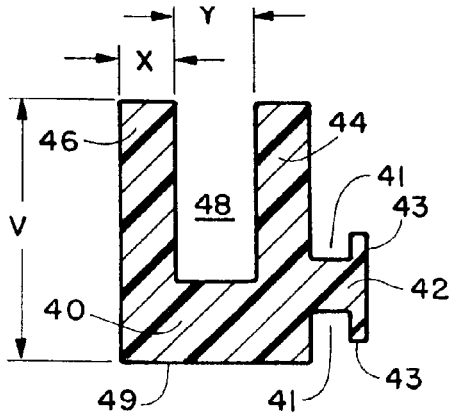
FIG. 2 is cross-section end view of a field guide.
Figure 3:
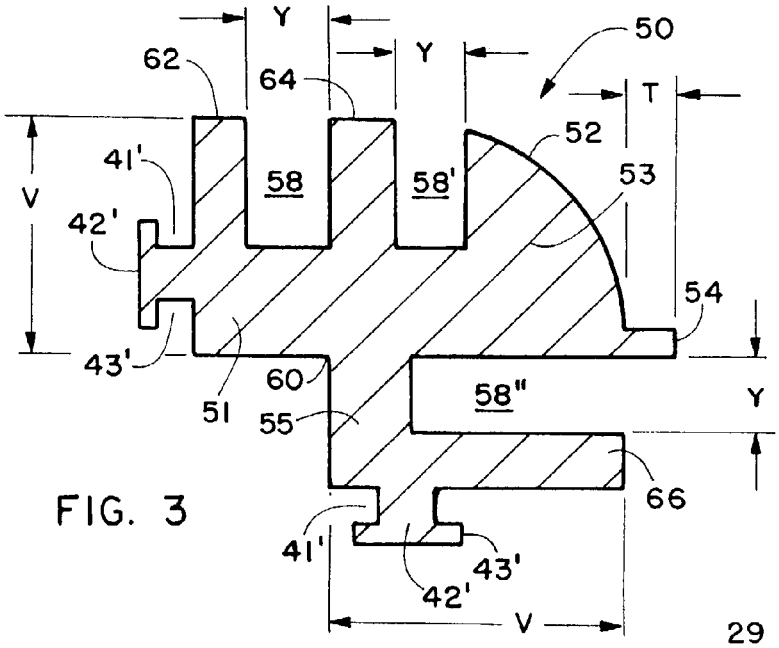
FIG. 3 is cross-section end view of a corner guide.
Figure 15:
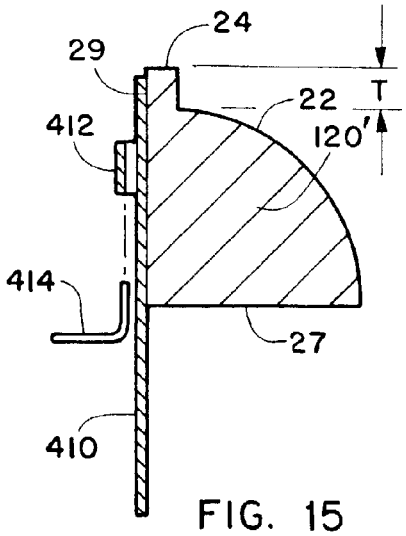
FIG. 15 is a cross-section end view of another embodiment of trim guide used in conjunction with a flat screed.
Figure 11:
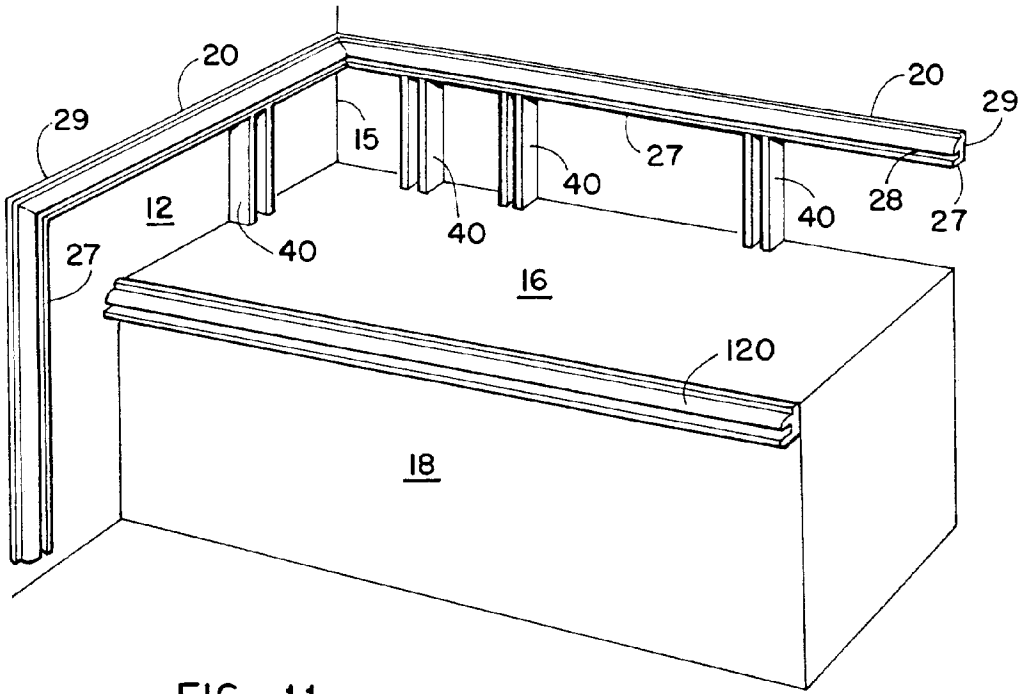
FIG. 11 is a perspective view of several guide devices in application.

Turning to FIGS. 1–3—these figures are end views of each such component; each of which can be of any length suited for the purpose to which applied. These guides may be made of any suitable material such as, but not limited to, wood or wood composites, metal or metal composites, plastic or plastic composites, or any combinations thereof. FIG. 1 shows a perimeter trim guide 20. FIGS. 10, 11, and 15 illustrate several applications of this trim guide 20 for a sink cut-out [FIG. 10], on and around a vertical surface 12 to establish, as necessary a horizontal aspect or plane for the trim-perimeter guides 20 on top [FIG. 11], and in conjunction with a side surface screed 410 [FIGS. 11 and 15]. The trim guide used in conjunction with a side surface screed 410 may, but need not be, modified to exclude the channel 28.

The trim guide of FIG. 1 has a first side 27, a second side 29, a third side [as illustrated here] with a rounded [curved] surface 22 and a registration channel 28 in between, and an extension or tile lip 24 projecting linearly from and planar to the second side 29. The length of this extension is approximately equal to the thickness of the tiles to be laid. The thickness is referred to herein as "T"; therefore, the length of the extension is approximately equal to "T". Typical tile thickness may range from 1/16" to 5/8" or more. For vertical [wall] applications, the second side 29 is set onto and around the vertical surface with the first side surface 27 facing toward the side to be tiled (i.e., the field tile surface). See FIG. 11 which illustrates how the trim guide 20 is set to establish an outline or perimeter of the wall surface upon which mortar and later tile is to be applied. The outline is established by the trim guides 20 and they are horizontally [for the horizontal plane or aspect] and vertically aligned [vertically in two dimensions; i.e., left-to-right vertical alignment and adjustment and front-to-back vertical alignment and adjustment for the proper vertical plane or aspect]. The terminal end 26 of the first side surface 27 serves as a registration guide for the cement application [mortar float] or depth "V". The distance from the terminal end 26 to the second surface side 29 should approximate "V". Since most applications use a one-half inch mortar base, "V" [the distance from the second surface 29 to the terminal end 26] should be about one-half inch. Such depths, however, may vary from about one-fourth of about one inch, more or less, as necessary or desired. The registration channel 28 serves several purposes:

(1) registers one trim guide 20 [which has been previously aligned and adjusted] with one or more trim guides 20 by aligning the channel 28 of the aligned trim guide 20 with the channel 28 an non-aligned trim guide 20 and inserting an elongated object [not shown but which may be a rigid rod or rod-like object or a flexible object, such object to include, but not be limited to, a dowel rod, a nail, a rubber-like or vinyl-like elongated object, and the like] into each channel 28 such that the elongated object covers the junction of the two adjacent trim guides 20, extends into each, and aligns the adjacent channels with one another such that the previously non-aligned trim guide 20 aligns with the aligned trim guide;

(2) accepts a fastener, such as, but not limited to a screw, a nail, a staple, and the like, to fasten the trim guide 20 to the vertical surface 12 or horizontal surface 16; and (3) supports the leveling device or level support [such devices shown in FIGS. 12–14, reference characters 210, 240, respectively].

Trim guides 20 applied to such wall [vertical] surfaces do not have the lip extension 30. The lip extension 30 is planar to the first side 27 and approximately perpendicular to the second side 29. It generally is associated with trim guides 20 used around a cut-out on a horizontal surface 16 for a sink 14 (FIGS. 1 and 10 refer) and serves to secure the trim guide 20 sections in place around the sink 14, may abut the perimeter of the sink 14, and to thereby provide a barrier between the sink and the cement base to be applied on the horizontal surface 16. FIG. 11 also illustrates a trim guide 120 application on a vertical surface 18 below a horizontal surface 16 which may be used in conjunction with screed 410 as illustrated in FIG. 15.

The trim guide 20 used on vertical surfaces does not have the lip extension 30. As mentioned above, first an outline of the vertical surface 12 to be tiled is established. Trim guides 20 are placed around the outer perimeter of the vertical surface 12. The second surface 29 of trim guide 20 is placed against the vertical surface 12 [and/or horizontal if necessary] with the first surface 27 facing downward [where the trim guide 20 is applied horizontally] and facing inward [where the trim guide is applied vertically]. Stated differently, the first surface 27 would face toward the direction of tile or mortar application. The channel 28 has a width approximately equal to "Y" [which may range from about *frax*;1;16" to about ⅝"] and, among other functions, serves in association with bracket 80, leveling device 210, or level support 240, or any suitable combination thereof as the case may be, to set a true horizontal [for the horizontally disposed trim guides 20] and to set a true two-dimensional vertical [for the trim guides 20 vertically disposed].

Figure 16:
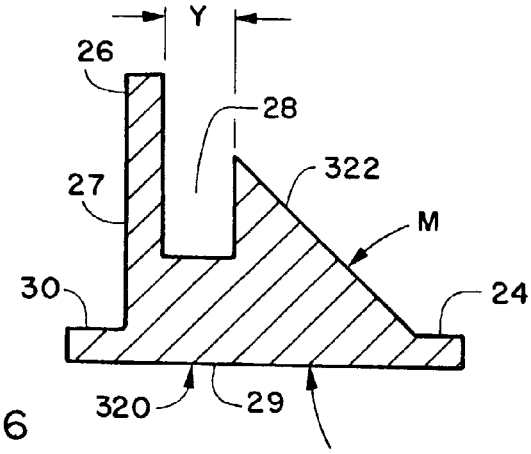
FIG. 16 is a cross-section end view of another embodiment of a trim guide.

Another embodiment of the trim guide is illustrated in FIG. 16. this trim guide 320 is similar in all respects to the previously described trim guide 20 except for the lack of a rounded surface 22 between registration channel 28 and tile lip 24. Here in place of the rounded surface 22 is an diagonal surface 322 bearing angle "M". "M" may be any angle between 30° and 60°; but it is best suited for the intended purposes of tile-laying if such angle is 45°.

Once the perimeter of the trim guide 20 has been placed [but not necessarily set at true horizontal and vertical], field guides 40 are vertically placed at various locations of the vertical surface 12. FIG. 11 shows a sample, not a limitation, of such placement within the outlined perimeter. Optimally the vertical surface 12, in both dimensions [front-to-back and side-to-side] should be at true 90° to a true horizontal plane so that mortar float [and later-applied field tiles] will also be at a true 90° to the horizontal plane. The field guide 40 [or a vertically disposed trim guide 20] is used to attain a true 90° to that horizontal plane. In this regard, and using the field guide 40 as an example [for vertically disposed trim guides 20, registration channel 28 is similarly used], note that the field guide 40 has a first 44 and a second wall 46 which defines a registration channel 48 in between. The registration channel 48 has a width approximately equal to "Y". The width of either or both such walls 44, 46 may be, but need not be approximately equal to width "X" [which may range from about 1⁄16" to about ½"]. When placed vertically on the wall 12, the base 49 is adjacent to the vertical surface [wall] 12. This channel 48 also serves as a registration with the trim guide 20 [in such cases, when the two guides 20, 40 adjoin, the rounded surface 22 of the trim guide 20 is suitably channeled downward to approximate width "Y" such that the channels 28 of the trim guide 20 resemble the letter T].

Though not necessary nor required on all field guides 40, the field guide illustrated in FIG. 2 has, on one side, though it may have such on both sides or neither, a vertical guide 42 having two slots 41 and two rails 43. Ideally, the bottom of the field guides 40 should approximately abut the horizontal surface 16 at the bottom and should approximately abut the first side 27 of the trim guide 20 at the top. The walls 44, 46 of the field guides 40 should approximately be on the same plane and approximately flush with the terminal end 26 of the trim guide 20. Generally, the distance from the base 49 to the ends of the walls 44, 46 should be approximately equal to "V" [the desired depth of the mortar float which, in most standard applications is about one-half inch]. These component walls 44, 46 and terminal ends 26 will serve as guides for the cement base or mortar float to be applied and established. Their true two-dimensional vertical and horizontal planes first should be established and, once established, the field guides 40 and trim guides 20 secured in place. Where tile is to be applied to an inside corner 15, it is best to place one field guide 40 on each wall surface 12 adjacent to the corner—approximately one inch to about six inches from the corner 15.

Once true horizontal planes and true vertical planes are established for the trim guides 20 and field guides 40, suitable mortar or cement is applied to the vertical surface 12. The terminal end 26 of the trim guide 20 and the walls 44, 46 of the field guide 40 serve as leveling guides for striking or removing excess cement from the vertical surface, or any surface, after an ample of cement has been applied to thereby create the cement or mortar float. Any straight-edge of a suitable length will suffice for this purpose provided it is of sufficient length to overlap its respective leveling guides formed by the terminal ends 26 of the trim guides 20 and the walls 44, 46 of the field guides 40.

Figure 4A:
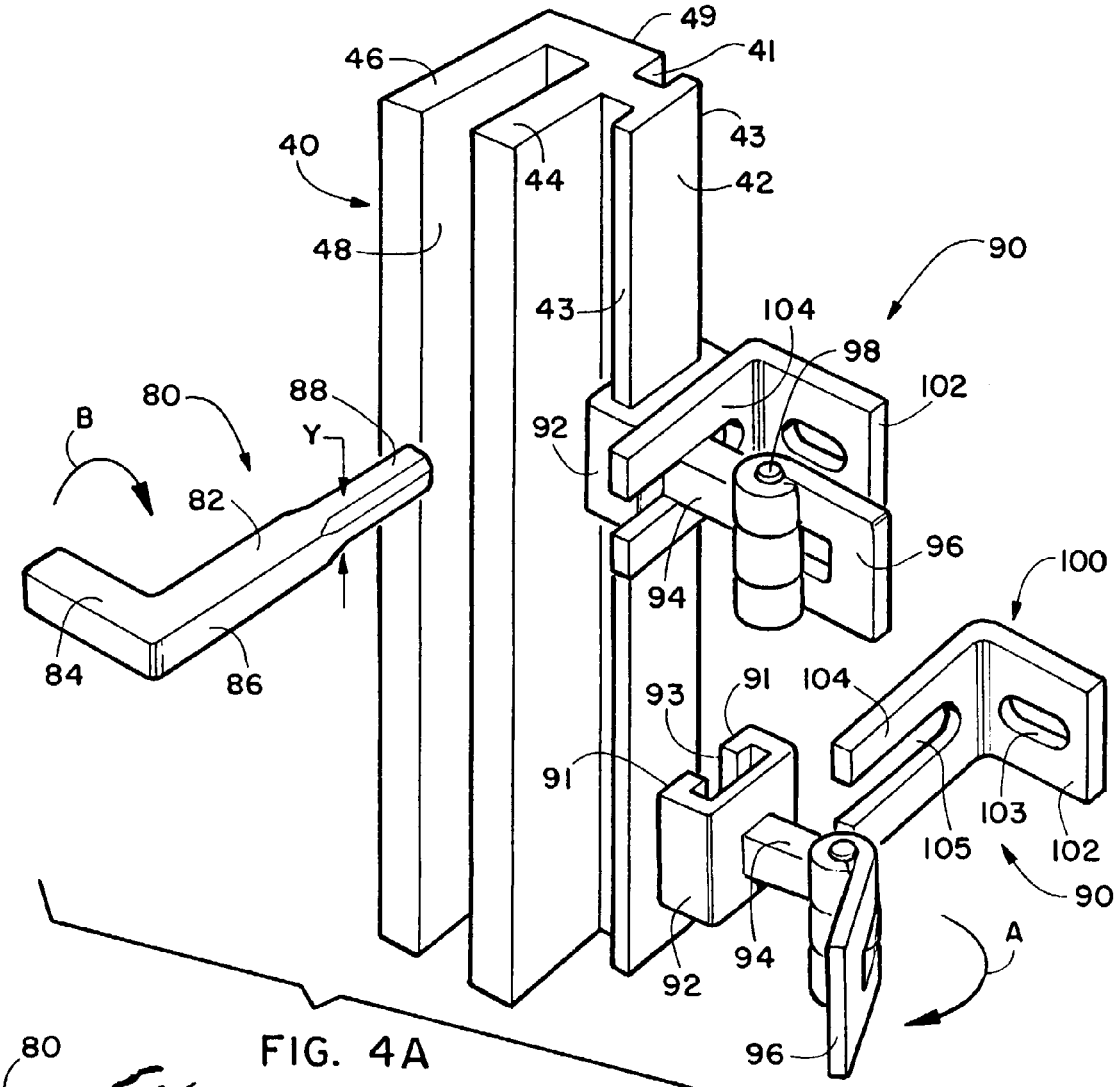
FIG. 4A is a perspective view a of vertical registration and locking device and bracket member.
Figure 5:
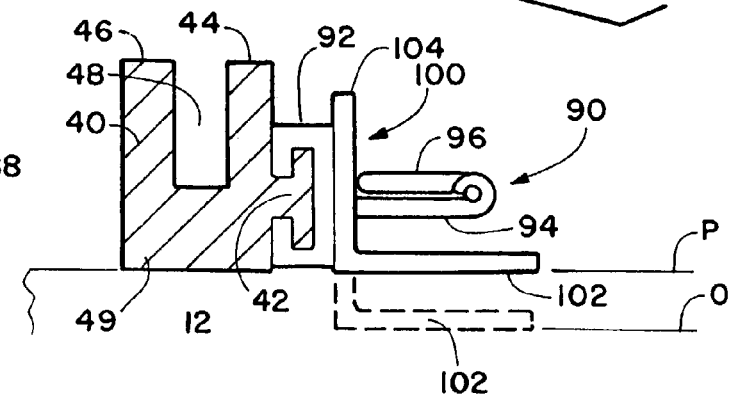
FIG. 5 is a cross-section end view of a field guide in combination with a vertical registration and locking device.
Figure 6:
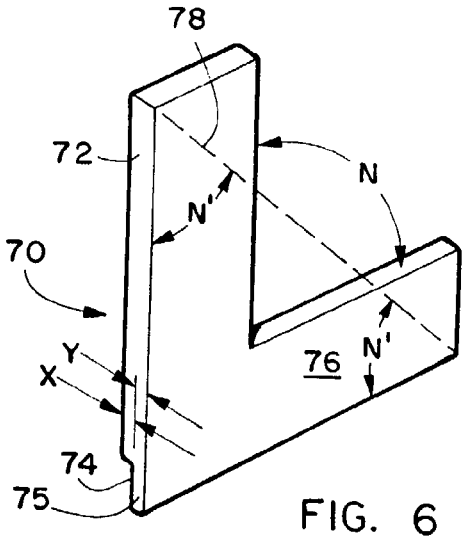
FIG. 6 is a perspective view of a tile application guide device.

The vertical guide 42 of the field guide 40 functions in cooperation with the snap bar 90 and shim bracket 100 combination [see FIG. 4A and FIG. 5]. This cooperation permits the artisan to establish and maintain a true vertical plane from the wall surface 12 [i.e., front-to-back vertical]. The snap bar 90 has an end member 92 with two slot rails 91 and a rail channel 93 which insert onto, and may ride along, the vertical guide 42 of the field guide 40. It also has a stem 94 extending away from the end member 92 with a pivotable locking arm 96 and hinge 98. FIG. 4A shows the upper-most snap bar 90 in an open or unlocked state and mounted onto the vertical guide 42 [the lower-most snap bar 90 is illustrated in a detached state or exploded view and not mounted on the vertical guide 42]. Moving the locking arm 96 toward the end member 92, in the direction of Arrow A [after the bar 90 bracket 100 combination has been established and inserted onto the vertical guide 42 and placed in the desired locations and shimmed from the wall 12] locks that position from the wall 12. FIG. 5 illustrates the locked state. The snap bar 90 is inserted onto the vertical guide 42 [as illustrated in FIG. 4A] with the pivoting movement of the locking arm 96 to be away from the wall surface 12, the shim slot 105 of the shim bracket 100 is placed onto the stem 94 of the snap bar 90 with the first plate 102 of the shim bracket 100 facing the wall surface 12. Once so inserted, the combination bar 90 and bracket 100 is ridden up and down to any desired location on the field guide 40.

With the combination bar 90 and bracket 100 on the vertical guide 42 and in the unlocked state the first plate 102 of the shim bracket 100, through its shim slot 105, may be slid back and forth on the stem 94. Such movement cause the field guide 40 to move forward or backward in tandem therewith. The first plate 102 is to abut the wall 12. As the stem 94 is pushed closer to the first plate 102 and abuts the first plate, the combination bar 90 and bracket 100 moves the back 49 of the field guide 40 closer to the wall 12 [refer to position "P" of FIG. 5]. Moving the first plate 102 away from the stem 94 brings the back 49 of the field guide 40 away from the wall 12, to position "O" [the first plate 102 shown in phantom line]. One or more such bar 90 bracket 100 combinations may be inserted onto the one or more field guides 40, slid up and down on the respective vertical guides 42, adjusted [shimmed] as described above to and from the wall 12, as necessary until a true front-to-back vertical is attained. Once so attained, the locking arm 96 is moved over in the direction of Arrow A to press against the second plate 104 of the shim bracket 100 to secure that front-to-back vertical. A suitable fastener [nail, screw, and the like] may be inserted into the wall surface 12 through aperture 103 to securely hold in place thereat the now locked-in-place snap bar 90 shim bracket 100 combination.

The side-to-side vertical also should be established for that guide. Once both verticals of a guide [front-to-back and side-to-side] have been established, the field guides 40 are secured in place. How these true horizontal and vertical planes are established through use of the leveling device 210 and level support 240 [as illustrated in FIGS. 12–13] is described later.

FIGS. 4A and B also illustrate another adjustment/registration bracket 80 for use in combination with the registration channels of any of the guides. As illustrated in FIG. 4A and in FIG. 7, it is used in combination with channel 48 of the field guide 40, not be means of limitation but merely by way of example only. This provides for horizontal registration for proper application of tiles. The bracket 80 comprises an elongated body 82 with a step 84 at one end and a tail 88 at the other. The key here is the tail 88. The width of the tail 88 is greater than its height and is approximately equal to or slightly greater than the width of the registration channels 48 of the field guide 40 [and registration channels 28, 58, 58', and 58" of trim guide 20 and corner guide 50, respectively]; the width of the tail 88 is, therefore, approximately equal to or greater than "Y". The bracket 80 is inserted into the registration channels 48 of two or more adjacent field guides 40 first by turning its bottom 86 to face either wall 46, 44 [as illustrated in FIG. 4A, the bottom 86 is facing the first wall 44]. After such insertion, the bracket 80 is rotated approximately 90° in the direction of Arrow B such that the step 84 faces up and the bottom 86 faces down. Because the width of the tail 88 is equal or greater than the width of the channel 48 into which rotated, the bracket 80 is thereby locked in place by friction-fit. Though locked, with some degree of pressure therein, the bracket 80 may be moved up or down slightly to measure for, and to, attain a true horizontal to use as a guide when applying field tiles to the wall 12.

Figure 4B:
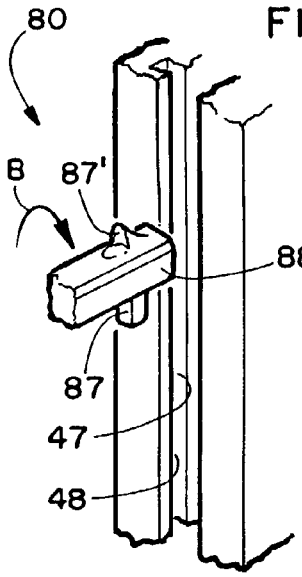
FIG. 4B is a perspective view of another embodiment of a vertical registration and locking device and bracket member.

FIG. 4B illustrates two other embodiments of the bracket 80. At the tail end 88 of each bracket 80 may be placed either a lock member 87 [such as, but not limited to, a nub, a detent, a protrusion, and the like] or a hook-like member or barb 87', or any combinations thereof. Systems employing a bracket 80 having a lock member 87 would also have within the respective channels 28, 48, 58 of the respective guides 20, 40, 50 one or more receiving channels [or slits] as illustrated by reference character 47 [though field guide 40 is used in this illustration, the discussion which follows is equally applicable to the trim-perimeter guide 20 and the corner guide 50; i.e., each having one or more, in any combinations, receiving channels and, as such, would be adapted to cooperate with the brackets 80 having the locking members 87, 87' described above].

Such receiving channels 47 generally would be on the inner wall of either or both walls 44, 46; inner walls being the walls which face each other in the channel 48. The receiving channel 47 is generally an elongated channel running the full length of the guide channel 48 on either inner wall or on both inner walls. A bracket 80 having this locking member 87 is inserted into the channel 48, slid up and down as necessary, and, when at the desired location, the bracket 80 then may be rotated in the direction of arrow B until the locking member 87 enters into and presses itself into the receiving channel 47. The locking member 87 may be of any geometric shape and may be rounded, squared, or pointed at its end. Being rounded or pointed facilitates rotation of the bracket 80 into the channel 48 with or without the channel 48 having a receiving channel 47 therein and further provides for greater locking capabilities.

Brackets having a barb 87' at the tail end 88 do not generally require, but may have, a receiving channel 47. When such brackets are used, they are inserted as previously described and illustrated in FIG. 4A. When the bracket having such a hook-like member 87' is rotated, the curved hooks barbs either engage the sides of the inner walls of the channel 48 [if the walls are made of a soft material or wood] or press so firmly against the inner walls that they hold fast.

Figure 7:
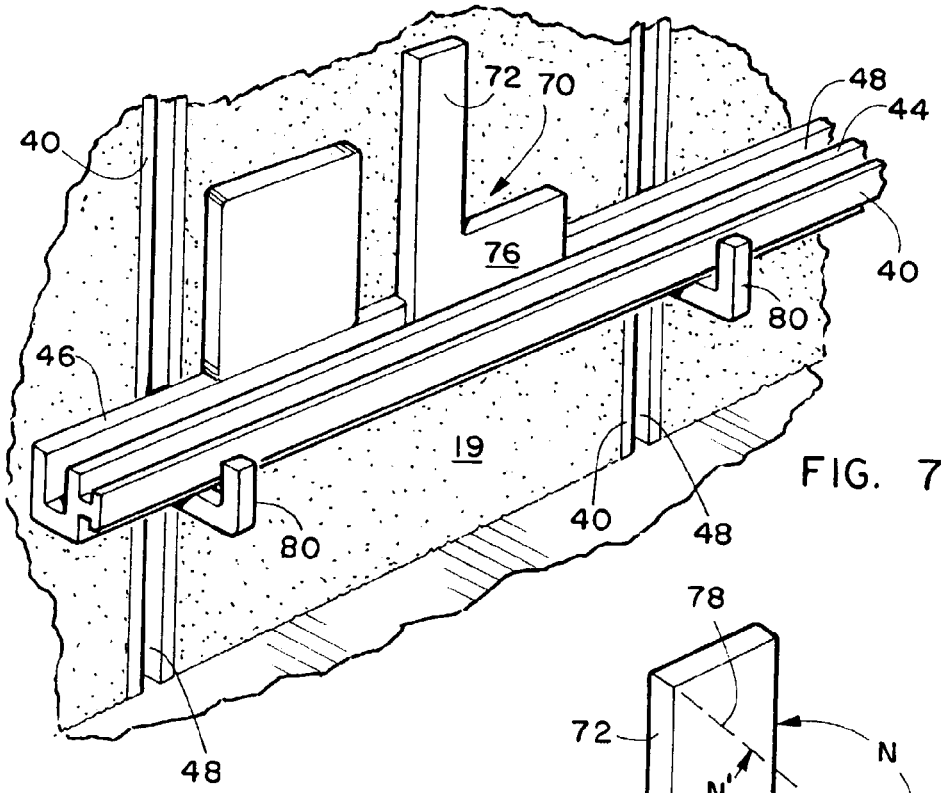
FIG. 7 is a perspective view of a tile application alignment system.

Referring to FIGS. 6 and 7, in particular component 70, the tile application guide. The tile application guide 70 is a component having a lower side 76 [horizontal side of the L-shape as illustrated] and an upper side 72 [vertical side of the L-shape] at right angles to one another; "N" is equal to approximately 90°. Though illustrated in combination to form the shape of the letter L, any shape, such as a square or a rectangle, may be established. A portion of the bottom of the lower side 76 is cut out from one end to the other defining a slot [or step] 74. This slot [step] 74 runs the full length of the bottom of the lower side 76 further defining a crosspiece 75 thereat. The width of the crosspiece 75 is approximately equal to width "Y", The width or depth of the cut-out section is approximately equal to width "X". After an artisan roughs out [outlines] the surface to be tiled, has established and attained the respective vertical and horizontal surfaces [akin to the illustration in FIG. 11], has laid the mortar 19, has leveled the mortar 19, the mortar 19 has set, adhesive has been [though in sequence, need not have been]

applied, the artisan generally should establish the horizontal and vertical planes for tile application such that the tiles applied are also properly horizontal and vertical in look and finished appearance. For a diagonal tile application, the tile application guide 70 may resemble a triangular shape with a diagonal surface edge 78 bearing angle "N" or approximately 45°.

For the purpose of establishing the horizontal and vertical planes [or diagonal or any desired geometric plane or aspect] for tile application, at least two brackets 80 are placed in separate field guides 40—the field guides may be adjacent to one another or may be several field guides apart. As shown in FIG. 7, the brackets 80 are placed into adjacent field guides 40. A separate field guide 40 is placed onto the brackets 80, channel-side 48 up, and supported by the brackets 80 thereat. The leveling device 210, using either elongated side 214A or 214A', is inserted into the channel 48 of the field guide 40 being supported by the brackets 80. Either or both brackets are moved up or down as necessary to establish a horizontal plane. Once such is established the crosspiece 75 of the tile application guide 70 is inserted into the channel 48. Since the width of the cut out section [slot] 74 is approximately equal to "X" and the thickness of the wall 46 of the field tile 40 is approximately equal to "X", the backside of the upper section 72 of the tile application guide 70 is approximately or nearly flush with the mortar 19 surface. The crosspiece 75 is approximately equal to "Y", the approximate width of the channel 48, thereby permitting the tile application guide 70 to slide within the channel 48 if necessary yet also to be firmly maintained within the channel 48.

If adhesive had not been applied to the mortar surface 19 prior to this point, the field guide 40 resting on the brackets 80, and the tile application guide 70 are removed from the brackets 80, adhesive is applied, the field guide 40 and tile application guide 70 are returned to the brackets 80, and the tile application may begin. If adhesive for the tiles had previously be applied over the mortar surface 19, the tile application may begin. A tile is set on the wall 46 of the field guide 40 and slid over to the edge of the upper side 72 of tile application guide 70. Such a tile abutting the wall 46 and the edge of the upper side 72 of the tile application guide 70 ensures that this initial tile is perfectly oriented as to horizontal and vertical planes. The upper side 72 of the tile application guide 70 is generally of a greater length than the length [or height] of the tiles being applied. For good vertical application of tiles, the length of the upper side 72 should be of a length approximately equal to or greater than the length of two tiles. After one or more tiles have been applied in this matter, the tile application guide 70, the field guide 40, and the brackets 80 may be removed as the applied tiles may now serve as horizontal and vertical registration guides for the remaining tiles to be applied.

If a tile application guide 70 is square or rectangular, a tile may abut either side of top of the tile application guide 70. If it is L-shaped, it may abut the edge of the upper side 72 as described above or may rest upon the inside corner of the L-shape.

Figure 8:
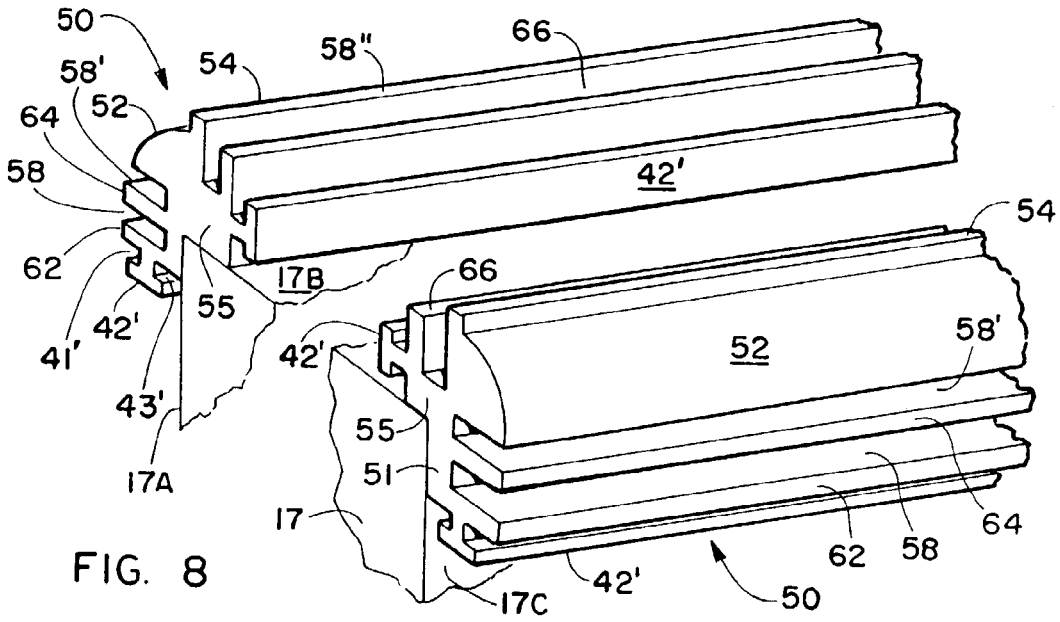
FIG. 8 is a detailed perspective view of the corner guide in use.

The corner trim guide 50 of FIG. 3 completes the guide components of this system. It is a more complex component than the trim guide 20 and the field guide 40 yet comprises most of the elements of those guides. As positioned in this figure, at its left is a first section 51 which is structured nearly exactly as is the field guide 40; to the right of the first section 51 is a second section 53 which is structured very similarly as is the trim guide 20; and below the second section 53 is a third section 55 which is structured very similarly as is the field guide 40. In this regard, the first section 51 has a vertical guide 42' with slots 41' and rails 43' for accepting a bar 90 and bracket combination 100 as described above. It also has a first wall 62 and a second wall 64 defining there between a registration channel 58. The second section 53 has a guide extension 54 [or guide tile lip, similar to the tile lip 24 of the trim-perimeter guide 20], a rounded section 52, and a registration channel 58' [similar to the rounded section 22, and registration channel 28, respectively, of the trim guide 20]. The third section 55 has a vertical guide 42' with slots 41' and rails 43' also for accepting a bar 90 and bracket combination 100 as described above. It also has wall 66 with a registration channel 58" between the wall 66 and the guide extension 54. The reference numeral 60 represents the inside corner [corner seat] of the corner guide 50 and is generally placed onto an outside corner surface with the guide extension 54 facing up and the first section 51 facing down as illustrated in FIG. 8. Referring to FIG. 3, as illustrated here, the base of the first section 51 extends left of the corner seat 60 and the base of the third section 53 extends downward from the corner seat 60 with each base, at the junction of the corner seat 60 forming approximately a 90° angle. The distance from each base of the corner guide 50 to the ends of its respective walls 62, 64, 66 is approximately distance "V". The base of the second section 53 is approximately planar with the base of the first section 51 and approximately perpendicular to the base of the third section 55.

The corner guide 50 is generally used for any multi-cornered outside-corner surfaces such as, but not limited to, a dam 17 for a shower, where any combination of one or more horizontal-vertical surfaces are to be tiled. The dam 17 in FIG. 8 illustrates three surfaces; a vertical surface 17A adjacent to a horizontal surface 17B adjacent to another vertical surface 17C, the three of which form the dam 17. FIG. 8 shows generally how the corner guide 50 may be used and placed on outside corner surfaces where each surface extending away from the corner guide 50 is to be tiled. The corner guide 50 may be horizontally disposed as illustrated in FIG. 8 or may be vertically disposed [not illustrated] as the case may be. Regardless, it may be used for establishing respective vertical and horizontal alignments [using respective registration channels 58, 58', 58", as necessary, as described above for trim guide 20 and field guide 40] when two or more outside corner surfaces are to be tiled. It also may be used in lieu of trim guide 120 on horizontal-to-vertical surface 16, 18 as illustrated in FIG. 11 when just two adjoining outside corner surfaces are to be tiled.

FIG. 8 illustrates that each corner 60 of the corner guide is placed on the corner of the dam 17 such that the guide extensions 54 are facing up. True horizontal alignment is established by using the level components 210, 240 as necessary and the respective registration channels 58, 58', or 58". The first 62, second 64, and third 66 walls of the corner guide 50, in conjunction with either trim guide 20 or field guide 40 or both as described above, aid to establish vertical and horizontal alignments and to lay the mortar float over the surface to be tiled. The corner guide 50 in this application need not, but may have, the respective vertical guides 42'. For outside corners of strictly vertical surfaces [i.e., wall-to-wall surface], the corner guides 50 are vertically disposed on the corner surface and the respective registration channels 58, 58', or 58" serve to establish two-dimensional vertical alignments. As for the three guide components 20, 40, 50 all respective registrations channels 28, 48, 58, 58', 58" are approximately of the same width as represented by "Y".

Once the various guide components are placed, adjusted to attain a true vertical or true horizontal or both, and locked as necessary, cement [mortar] is applied to the surface. As previously described, the terminal end 26 of the trim guide 20 in combination with the first and second walls 44, 46 of the field guide 40 and, as necessary or desired, in combination with the walls 62, 64, 66 of the corner guides 50, are used as depth gauges or guides for the cement [mortar float, depth "V"] to be applied to the respective substrate after which the tiles are applied on the mortar float. In this regard, cement may be applied generously. A long level, with each end of the level resting of the terminal end 26 walls 44, 46 combination, and walls 62, 64, 66 combination, is moved along the surface removing excess cement and, in the process, creating a true horizontal and/or vertical flat surface. For corners as shown in FIG. 8, the walls 62, 64 of the first section 51 of the corner guide 50 are used for vertical surfaces; and for horizontal surface the two third walls 66 are used.

Another component 110 is shown in FIG. 9 and usable, by way of example only, not by way of limitation, in conjunction with the structure of FIG. 10 consisting of four joined trim guides 20 forming a square or rectangular shape [referred to in that figure as 20A, 20B, 20C, and 20D]. As illustrated, the component 110 is an angle registration device comprising a surface area or slat having at least an inner side 115 with at least two rails 118 of a pre-determined angle "D" for attaining and securing the desired angles in an application; 90° angles are generally preferred for cut-out areas into which sinks 14 [for example, or other insertable objects] are to be installed, though the angle registration device 110 may be constructed to attain and secure any desired angle. To attain such angle, the angle from the inner side 115 to each rail 118 should be one-half "D" or approximately 45°. For corners where more or less than 90° is desired, the angle from inner side 115 to each rail may range from approximately 30° [or less] to approximately 60° [or more].

As illustrated in FIG. 9, the first end 112 and the second end 114 here are, though need not be, angled at 45° to the first and second sides 113, 115. Two registration rails 118 are on the underside of the device 110. The width of such rails is approximately equal to "Y". It is the registration rails 118 which must be angled at 45° to, at a minimum, the inner side 115. In configuration where there is a first or outer side 113 and a second or inner side 115, with each such side parallel to one another, the rails 118 will be angled equally to each such side. As so structured, and before all the guides are secured to their surfaces, the device 110 is be used by inserting one registration rail 118 into one registration channel 28 of two adjacent trim guides—first into the channel of trim guide 20A. The other registration rail 118 would then be inserted into the registration channel 28 of either adjacent trim guide 20B or 20D. The angle registration device 110 is inserted into each such adjacent corner. This assures the artisan that a true 90° angle has been attained at each corner.

In this regard, when a horizontal surface 16 has been cut-out to accommodate a sink 14, for example, the sink 14 is placed into the cut-out and mortar is dispensed around the sink's perimeter. In the absence of particularly careful detailed work, mortar may encroach the sink's perimeter, dry thereover, and prevent easy removal of the sink at a later time should the need arise. To facilitate later sink removal, the combination trim-perimeter guides 20A–D [illustrated in FIG. 10], each having the extension lip 30, are used prior to mortar application on the horizontal surface 16.

The combination 20A–D is configured with the second side 29 of the respective trim-perimeter guides being placed down on top of the sink 14 around its perimeter [see FIG. 1 also for this placement]. The third side 22 [rounded surface in this illustration] of each trim-perimeter guide faces the sink 14 [in this example, a quarter round trim tile will generally be applied to and over the rounded section 22]. The lip extensions 30 should rest outside the sink perimeter and on or near to the horizontal surface 16. This creates a barrier between the sink 14 and the horizontal surface 16 and, concomitantly, between the sink 14 and the mortar which is to be applied later. After these trim-perimeter guide combinations 20A–D are so formed around the sink perimeter, the registration device 110 is used as described above to establish a true 90° angle at all four corners. After such placement and registration, the combination trim-perimeter guide 20A–D is secured in place through the respective channels 28 with suitable fasteners. Terminal end 26, in conjunction with other guides as described above, serves as the guide for mortar application and mortar float.

FIG. 12 is the leveling device 210 which has a cylindrical housing 212 set upon a flat base 214 which, may, but need not, extend on all sides 214A, 214A', 214B, 214B' beyond the cylinder 212 perimeter. Within the housing 212 is a first leveling tube 221, axially disposed and parallel to the cylinder 212, with level markers 224, 226 between which a bubble 225 should reside to move therein and to reflect a true level or horizontal plane. Shown within the cylinder 212 is a light source 223 connected to a switch 227 and a suitable power source, such as, but not limited to a battery or solar cell [not shown]. A second leveling tube 221' is perpendicularly disposed to the first leveling tube 221 and also is parallel to the base 214. It is similarly configured as the first leveling tube 221 above described complete with level marks and bubble 225'. The light source 223 illuminates either one or both leveling tubes 221, 221'.

Cut through one elongated side of the base 214 is a channel or slot 216 above and below which are an upper ledge 215 and a lower ledge 217. The upper ledge 215 and lower ledge 217 combination of the base 214 may, as addressed above, extend on all sides beyond the perimeter of the cylinder 212, such extensions to be of a sufficient distance to permit insertion of the ledge combination 215, 217, from any side 214A, 214A', 214B, or 214B', of the leveling device 210, into the channels 28, 48, 58, 58', and 58" of the respective guides 20, 40, and 50. The distance from upper ledge 215 and lower ledge 217 is represented by reference character "Z", and "Z" is approximately equal to or slightly greater than "Y". When any one or more of the guide components 20, 40, 50 are placed on their respective surfaces as described above, to assure and attain a true horizontal plane, the base 214 may be inserted into any one or more channels 28, 48, 58, 58', 58" of a respective, horizontally disposed, guide 20, 40, 50 and the guide adjusted horizontally until the first leveling tube 221 registers a true horizontal at which time the respective guide is secured in place. Since the width of such channels is "Y" and "Z" is approximately equal to or greater than "Y", the channels easily hold and support the leveling device 210 therein.

The two dimensional vertical alignments [i.e., front-to-back and side-to-side verticals of the field guide 40, for example] may be attained by several methods. The alignment methods may employ the use of level support 240 in combination with leveling device 210 or use of the leveling device 210 without the level support 240. FIG. 12 illustrates the structure of the level support 240. One side 241 of level support 240 has a ledge 248 extending outward from that one side 241. The width of the ledge 248 is approximately "Z". On the other side 242 opposite to the one side 241 is a channel 246 transversing the length of the other side 242. The channel 246 is at a right angle to the ledge 248. The width of the channel 246 is approximately equal to "Y". In this regard, the base 214 of level device 210 is insertable from any side 214A, 214A', 214B, 214B' into, and supportable therein, by the channel 246, and is insertable from any side 214A, 214A', 214B, 214B' into, and supportable therein, by the registrations channels 28, 48, 58, 58', 58" of the respective guides 20, 40, 50 previously described.

For side-to-side vertical alignments, the key is that either leveling tube 221, 221' must be horizontally disposed and parallel to the wall surface such that the bubble 225, 225' will move side to side as the respective guide is so moved. Using a vertically disposed field guide 40 by way of example, for leveling tube 221 this is accomplished by inserting the extending base sides 214A or 214A' into channel 246, then inserting ledge 248 into registration channel 48, followed by moving field guide 40 side to side until the bubble 225 in the leveling tube 221 registers level. Using leveling tube 221', this is accomplished by inserting base sides 214B or 214B' into channel 246, then inserting ledge 248 into registration channel 48, followed by moving field guide 40 side to side until the bubble 225' of the leveling tube 221' registers level.

For front-to-back vertical alignments, the key is that either leveling tube 221, 221' must be perpendicularly disposed to the wall surface and approximately parallel to the ground such that the bubble 225, 225' will move front to back as the respective guide is so moved. Using a vertically disposed field guide 40 by way of example, for leveling tube 221 this is accomplished either (1) by inserting base sides 214B or 214B' into channel 246, then inserting ledge 248 into registration channel 48 or (2) by inserting base sides 214B or 214B' into registration channel 48, with either (1) or (2) then followed by moving [shimming] the field guide front to back [or back to front as the case may be] until the bubble 225 in the leveling tube 221 registers level. For leveling tube 221' this is accomplished either (1) by inserting base sides 214A or 214A' into the registration channel 48, or (2) by inserting base sides 214A or 214A'; into channel 246, then inserting ledge 248 into the registration channel 48, with either (1) or (2) then followed by moving [shimming] the field guide front to back [or back to front as the case may be] until the bubble 225' in the leveling tube 221' registers level. The snap bar 90 shim bracket 100 combination, having previously installed onto vertical guide 42, is locked in place to maintain this alignment.

At the point in time that all of the vertical alignments [two-dimensional as described above] and horizontal alignments for the respective guides 20, 40, 50 have been made, the respective guides will be secured in place. Although the order of operation disclosed placing the level device 210 into the level support 240 first followed by inserting the level support 240 into a vertically disposed channel, the operation may be reversed. There is no particular significance into which object is first inserted into what other object. For front-to-back vertical alignments, however, the respective guide generally would first be locked in place [i.e., securing the snap bar 90 shim bracket 100 combination and securing the respective guide 20, 40, 50 to the wall 12] followed by the side-to-side securing of the respective guide.

FIG. 13 illustrates the level device 210 inserted into the channel 28 of a trim guide 20. Since "Z" is approximately equal to "Y", the level device 210 secures well into the trim guide 20. The slot 216 on the base 214 of the level device 214 has a width represented by reference character "W". FIG. 14 illustrates the functionality and use of the slot 216 on screed-type devices 310 as described in my patents, U.S. Pat. No. 6,393,788 issued May 28, 2002, and U.S. Pat. No. 6,397,542 issued Jun. 4, 2002 [both of which are incorporated herein by reference], or similar screeds. The screed 310 in this figure has a top rail 330A and a bottom rail 330B [much like the screed in U.S. Pat. No. 6,393,788]. The screed, however, may also have only one rail [much like the screed in U.S. Pat. No. 6,397,542]. The thickness of the rails is represented by reference character "W", and "W" is approximately equal to or slightly less than "W'" [generally "W'", thickness of screed rails, may range from about 1/64" to about 1/4"]. In this regard, when using such screeds and the need for a leveling device 210 arises, the artisan merely inserts the upper ledge 215 and lower ledge 217 with the slot 216 being placed over and onto either a top rail 330A or a bottom rail 330B and the screed adjusted accordingly. FIG. 15 illustrates a trim guide 120', similar to trim guide 20 shown in FIG. 1 and trim guide 120 shown in FIG. 11, but without a registration channel 28. It is used with a flat screed 410 [FIG. 15] with slotted rearward protrusions 412 and a cooperating adjusting bracket 414 but no top or bottom rails. This type trim guide 120' also may be used in horizontal-to-vertical [or vice versa] surface tile applications as illustrated in FIG. 11 horizontal surface 16 to vertical surface 18 in lieu of using the corner guides 50.

Since many tiling projects are for new construction sites with limited or no electrical source where rooms with walls and ceilings are roughed in, the spaces are dark. This makes leveling difficult and generally requires an assistant to hold an illuminating device such as a flashlight. The light source 223 eliminates the need for other electrical sources and the need for an assistant. When the leveling device 210 is place as described above, depressing the switch 227 illuminates the light source 223 inside the leveling device 210. The light source 223 is structured within the leveling device 210 to illuminate either or both leveling tubes 221, 221'.

The base 214 also may be magnetized for adherence to external surfaces not having an extending rail [such as the type screed 410 illustrated in FIG. 15]. Though the leveling device 210 may be used for virtually any leveling type project, as designed, it is suitable for use with external surfaces having a horizontal projecting rail; such as a screed as described above or with the guides 20, 40, 50 previously described with or without the level support 240.

The system and components of the present invention simplify 'floating' and setting un-even, non-level, non-vertically surfaces and evenly applying various tiles, such as, but not limited to, vinyl, marble, ceramic, porcelain, composites, and the like, thereafter. The present invention incorporates the standard features of tile application into a standardized setting and application system; i.e., accounting for standard float depths [approximately one-half inch which are the approximate lengths of the second side 29 to the terminal end 26 of trim guide 20, which are the approximate lengths of the walls 44, 46 of the field guide 40, and the lengths of the walls 62, 64, 66 of the corner guide 50; and the extensions 24 of the trim guides 20, 120' extend beyond the respective rounded surface 22 approximately the same distance as the depth of a rounded trim (quarter round) tile and provide support and registration for the rounded trim tile]. The dimensions of these elements may vary with the tiles being applied and the desired depth of the mortar float desired. The key is that the elements, components, and system provides to the artisan and the industry what has been sadly lacking for immeasurable years.

The present disclosure includes that contained in the present claims as well as that of the foregoing description. Although this invention has been described in its preferred forms with a certain degree of particularity, it is understood that the present disclosure of the preferred forms has been made only by way of example and numerous changes in the details of construction and combination and arrangement of parts and method steps may be resorted to without departing from the spirit and scope of the invention. Accordingly, the scope of the invention should be determined not by the embodiments illustrated, but by the appended claims and their legal equivalents.

The invention claimed is:

1. A tile application system comprising:

(a) an elongated trim-perimeter guide for establishing a trim section or a perimeter or both, said trim-perimeter guide having a first side surface and a second side surface, a registration channel adjacent to said first side surface and approximately normal to said second side surface, a terminal end on said first side surface wherein said terminal end is at a predetermined distance, referred to as V, from said second side surface and wherein said registration channel has a width of a predetermined distance, referred to as Y;

(b) an elongated field guide insertable inside the perimeter established by said trim-perimeter guide, said field guide having a base, a first wall and a second wall having internal surfaces parallel to each other, said first and said second wall extending from said base, a field registration channel between said first wall and said second wall wherein said first wall and said second wall have a length from said base approximately equal to said distance V, wherein said first wall and said second wall have a thickness of a pre-determined distance, referred to as X, and wherein said field registration channel has a width approximately equal to said distance Y; and (c) tile registration means for aligning tiles to a preferred geometric plane prior to final application wherein said tile registration means comprises a bracket having an elongated body, a bracket step on one end of said elongated body, and a tail on another end of said elongated body, said tail having a height and a width wherein said width is greater than said height and wherein said width of said tail is approximately equal to or greater than said distance Y;

whereby after said trim-perimeter guide set for trim, or for a perimeter around a substrate to be tiled with one or more tiles bearing a thickness referred to as distance T, or for both and, on a vertical surface, said field guide set within the perimeter, and all guides aligned to respective horizontal and vertical planes, mortar is applied over the substrate and the mortar is registered to said terminal end and to said first wall or to said second wall or to both and wherein one or more said brackets are insertable in and held thereat by said field registration channel or said trim registration channel for aligning tiles.

2. The system as claimed in claim 1 wherein said trim-perimeter guide further comprises, on said first side surface, a lip extending beyond, and co-planar to, said first side surface.

3. The system as claimed in claim 2 further comprising an angle registration means for use with more than one said trim perimeter guide for establishing angles between more than one said trim perimeter guide, wherein said second side surface of each one of said trim perimeter guide faces said substrate, said angle registration means comprising a base member having a first end and a second end and an inner side in between said first end and said second end, a first registration rail adjacent to said first end and at a pre-determined angle to said inner side, and a second registration rail adjacent to said second end and at a pre-determined angle to said inner side.

4. The system as claimed in claim 3 wherein said pre-determined angle is between approximately 30° and approximately 60°.

5. The system as claimed in claim 3 wherein said pre-determined angle is approximately 45°.

6. The system as claimed in claim 3 wherein said first rail and said second rail have a width approximately equal to the width of said Y.

7. The system as claimed in claim 1 wherein said trim-perimeter guide further comprises a third side surface from said second side surface to said registration channel and an extension protruding from said third side surface at a point where said third side surface is adjacent to and co-planar with said second side surface.

8. The system as claimed in claim 7 wherein said third side surface is curvilinear.

9. The system as claimed in claim 7 wherein said third side surface is a substantially flat surface thereby forming a diagonal from said second side surface to said registration channel.

10. The system as claimed in claim 7 wherein said extension extends outward of a distance approximately equal to the distance of said T.

11. The system as claimed in claim 1 wherein said field guide further comprises a shim means for shimming said field guide front to back to attain and maintain a front-to-back vertical alignment.

12. The system as claimed in claim 11 wherein said shim means comprises an elongated stem on said field guide approximately equal in length as said field guide and extending outward from said first wall or from said second wall or from both, said elongated stem having an outward extending rail on either side of said elongated stem, or from both sides, and being approximately perpendicular to said elongated stem thereby forming a slot between said outward extending rail and said walls.

13. The system as claimed in claim 12 wherein said shim means further comprises a snap bar and a shim bracket combination adapted to glide on said outward extending rail, to shim said field guide front-to-back, and to lock in place a front-to-back vertical alignment after said field guide is so aligned.

14. The system as claimed in claim 13 wherein snap bar comprises an end member on one end, said end member having means for securingly engaging said outward extending rail and being glidable thereon; a stem member extending away from said end member; and a pivotable locking arm on another end of said snap bar.

15. The system as claimed in claim 14 wherein said shim bracket comprises a first plate and a second plate approximately normal to said first plate, said first plate having a shim slot adapted to engage said stem member and translate front-to-back thereon and further adapted to engage said pivotable locking arm to thereby prevent said shim bracket from front-to-back movement.

16. The system as claimed in claim 15 wherein said second plate further comprises a locking aperture adapted to receive an external fastener to thereby prevent said shim means from gliding on said outward extending rail.

17. The system as claimed in claim 1 wherein said tile registration means further comprises a tile application guide, said tile application guide comprising an upper side and a lower side, said lower side approximately perpendicular to said upper side.

18. The system as claimed in claim 17 wherein said tile application guide further comprises a cut-out section transversing a full length of said lower section defining a step and a crosspiece thereat wherein said step has a width approximately equal to the distance of said X and said crosspiece has a width approximately equal to the distance of said Y.

19. The system as claimed in claim 17 wherein said tile application guide comprises a diagonal third side, said diagonal third side adjacent to said upper side at one end of said diagonal third side and adjacent to said lower side at another end of said diagonal third side.

20. The system as claimed in claim 19 wherein an angle of adjacency between said diagonal third side and said upper end and between said diagonal third side and said lower end is between approximately 30° and approximately 60°.

21. The system as claimed in claim 19 wherein an angle of adjacency between said diagonal third side and said upper end and between said diagonal third side and said lower end is approximately 45°.

22. The system as claimed in claim 1 further comprising an elongated corner guide having a first section, a second section connected to said first section, and a third section connected to said second section, wherein said first section comprises a first corner base, a first corner wall and a second corner wall each extending outward from said first corner base, and a first registration channel between said first corner wall and said second corner wall.

23. The system as claimed in claim 22 wherein said second section comprises a second registration channel adjacent to said second corner wall and a second corner base approximately perpendicular to said second registration channel and linear with said first corner base.

24. The system as claimed in claim 23 wherein said third section comprises a third corner base, said third corner base adjacent to said first corner base at approximately a 90° angle defining a corner seat thereat, a third corner wall extending outward from said third corner base, and a third registration channel defined between said third corner wall and said second corner base.

25. The system as claimed in claim 24 wherein said first corner wall from said first corner base, said second corner wall from said first corner base, and said third wall from said third corner base each have a length approximately equal to the distance of said V.

26. The system as claimed in claim 24 wherein said first corner registration channel, said second corner registration channel, and said third corner registration channel, each have a width approximately equal to the distance of said Y.

27. The system as claimed in claim 1 further comprising a registering means for registering said trim-perimeter guide and said field guide to a true horizontal plane and to a true vertical plane.

28. The system as claimed in claim 27 wherein said registering means comprises a leveling device having a long side, a short side, and a device base extending outward from said leveling device on one or more sides, wherein said device base has a thickness approximately equal to or greater than the distance of said Y.

29. The system as claimed in claim 28 wherein said device base has a slot transversing said device base wherein said slot has a width of a predetermined distance, referred to as W.

30. The system as claimed in claim 29 wherein the distance of said W is approximately equal to or less than a thickness of a protruding rail of an external screed.

31. The system as claimed in claim 28 wherein said leveling device further comprises a leveling tube approximately parallel to said long side.

32. The system as claimed in claim 31 wherein said leveling device further comprises an illumination member for said leveling tube.

33. The system as claimed in claim 28 wherein said leveling device further comprises a leveling tube approximately parallel to said short side.

34. The system as claimed in claim 33 wherein said leveling device further comprises an illumination member for said leveling tube.

35. The system as claimed in claim 28 wherein said registering means comprises a leveling support for said leveling device.

36. The system as claimed in claim 35 wherein said leveling support comprises a first support side and a second support side, said first support side having a ledge extending therefrom wherein said ledge has a width approximately equal to the distance of said Y and said second support side has a channel perpendicular to said ledge wherein said channel has a width approximately equal to the distance of said Y.

* * * * *